US005786684A

United States Patent [19]

Bapat

[11] Patent Number: 5,786,684

[45] Date of Patent: Jul. 28, 1998

[54] APPARATUS AND METHODS FOR MINIMIZING OVER VOLTAGE IN A VOLTAGE REGULATOR

[75] Inventor: Vinod N. Bapat, Raleigh, N.C.

[73] Assignee: ABB Power T&D Company, Inc., Raleigh, N.C.

[21] Appl. No.: 710,318

[22] Filed: Sep. 16, 1996

[51] Int. Cl.[6] ..... G05F 1/16

[52] U.S. Cl. ..... 323/258; 323/301; 323/343

[58] Field of Search ..... 323/255, 258, 323/301, 340, 343

[56] References Cited

U.S. PATENT DOCUMENTS

| | | | |
|---|---|---|---|
| 3,619,765 | 11/1971 | Wood | 323/258 |
| 3,728,611 | 4/1973 | Elvin | 323/343 |
| 3,818,321 | 6/1974 | Willner et al. | 323/258 |
| 4,220,911 | 9/1980 | Rosa | 323/343 |
| 4,301,489 | 11/1981 | Stich | 361/9 |
| 4,363,060 | 12/1982 | Stich | 361/9 |
| 4,523,265 | 6/1985 | Deprez | 323/258 |
| 4,622,513 | 11/1986 | Stich | 323/343 |
| 4,623,834 | 11/1986 | Klingbiel et al. | 323/258 |
| 4,733,158 | 3/1988 | Marchione et al. | 323/258 |
| 4,860,145 | 8/1989 | Klingbiel | 323/257 |
| 5,006,784 | 4/1991 | Sonntagbauer | 323/343 |
| 5,119,012 | 6/1992 | Okamura | 323/343 |
| 5,402,057 | 3/1995 | D'Aquila et al. | 323/211 |
| 5,408,171 | 4/1995 | Eitzmann et al. | 323/343 |

*Primary Examiner*—Jeffrey L. Sterrett
*Attorney, Agent, or Firm*—Woodcock Washburn Kurtz Mackiewicz & Norris LLP

[57] ABSTRACT

A solid state voltage regulator and methods therefore are shown to include a transformer having a secondary coil, the secondary coil having a plurality of taps. A first solid state switch is connected between the regulator output and a first tap. The first switch need only have the capability of being turned on in response to a gate signal. A second solid state switch is connected between the regulator output and a second tap. The second switch has the capability of being turned on and turned off in response to gating signals. The output voltage resulting from the second tap is greater than the first tap. A controller, connected to the input, the output, the first switch and the second switch, senses the voltage present at the regulator input and output and generates gating signals in response to the sensed voltage. The voltage regulator may include several switches similar in construction and operation to the first switch. In such a regulator, the second switch is connected to the tap which results in the coil turn ratio yielding the greatest voltage compensation.

8 Claims, 3 Drawing Sheets

APPARATUS AND METHODS FOR MINIMIZING OVER VOLTAGE IN A VOLTAGE REGULATOR

FIELD OF THE INVENTION

The present invention relates generally to the field of tap changers used for voltage regulation and more particularly, the invention relates to methods and apparatus for dynamically regulating transformer output voltage, i.e., on-load regulation, through the use of solid state devices while avoiding the problem of over voltage.

BACKGROUND OF THE INVENTION

Electric transformers utilize the principle of electromagnetic induction to increase or decrease a voltage level from input to output. Generally, voltage present on a primary coil is induced on a secondary coil via electromagnetic flux through a core, which induced voltage classically has been described as follows:

$$v=2\pi\phi Nf \quad (1)$$

Since the amount of magnetic flux (f) genera ted by the primary coil is proportional to the number of turns in the primary coil, and since, from equation (1) the voltage produced on the output or secondary coil can be described as being generally proportional to the magnetic flux surrounding the secondary coil, the output voltage of the transformer is generally equal to the input voltage times the ratio of the number of turns in the input coil to the number of turns in the output coil. Consequently, by changing the ratio of input turns to output turns, output voltage can be changed or regulated. Tap changers operate according to this principle.

Tap changers select or change the turn in the secondary coil ("tap") which is connected to the transformer output. Since a different output coil turn is selected, each tap change will generate a different ratio of input to output turns resulting in a different output voltage. As recognized in U.S. Pat. No. 5,408,171—Eitzmann et al., incorporated herein by reference, changing taps on a transformer regulating winding has long been used to control voltage magnitude, voltage phase angle, or both, in electric power circuits.

Changing taps can be accomplished with the transformer either "on-load" or "off-load." As described in U.S. Pat. No. 5,408,171, off-load changes were accomplished using breakers to isolate the transformer and then manually switching the output connection. On-load changes required maintaining the regulating coil circuit while switching from one tap to another. Such changes were accomplished using a combination of selector switches and a diverter switch. Traditionally the selector switches and diverter switch were mechanically switched devices or load tap changers (LTC).

As was appreciated, one of the drawbacks of such systems was the time required to make a tap change. It was recognized that for damping electromechanical rotor oscillations in electric power grids or for compensating sudden load changes due to faults, "high speed" tap changing was needed to stabilize power supply networks. High speed was defined as after one cycle of power frequency.

Some efforts to achieve high speed tap changing involved the substitution of solid state devices, such as thyristors, for the diverter switch, but which maintained mechanically switched devices for the selector switches. U.S. Pat. No. 5,408,171 and U.S. Pat. No. 5,006,784—Sonntaghauer, incorporated herein by reference, disclose such schemes.

Other tap changer designs have been proposed which exclude mechanically switched devices and have instead connected thyristors directly to the transformer taps. U.S. Pat. Nos. 3,728,611—Elvin, 4,220,911—Rosa and 5,119,012—Okamura, all of which are incorporated by reference, disclose such schemes. Although the use of thyristors alone has the potential for significantly reducing the time needed to change taps, an additional problem results from the operating characteristics of thyristors, namely, over voltage. This phenomenon is very detremimental to the load since such fast tap-changers are used to boost voltage as much as 100% during voltage sag mitigation applications of up to 50%.

A thyristor is a multilayered semiconductor device which generally conducts between anode and cathode when an appropriate signal is applied to the gate. However, when the gate signal is removed, the thyristor will nonetheless continue to conduct until the current flowing through the thyristor returns to zero and the storage charge is depleted. Once the current reaches zero, the thyristor ceases to conduct. When a thyristor is used in a tap changer, particularly a tap changer designed for used in up to 50% sag mitigation applications, the characteristic of continued conduction until current returns to zero causes up to 200% over voltage (2 PU) at the output of the device for a period of over one half power frequency cycle.

In utility applications, tap changers are used to regulate voltage against a voltage "sag." Typically, during normal use the tap changer generates appropriate gate signals to enable a pair of antiparallel connected thyristors to select a tap which produces a desired output voltage, i.e., 240 volts. If a voltage sag occurs at the transformer input and the selected tap remains unchanged, the voltage at the transformer output will also sag. In order to avoid sag at the transformer output, the tap changer senses the sagging voltage and generates the necessary gate signals to turn off the current thyristor pair and enable a different thyristor pair. Changing the tap changes the coil turn ratio and thereby maintains the voltage at the transformer output substantially the same. The problem occurs when the voltage sag ends.

At the conclusion of a voltage sag, the tap changer senses the return of voltage at the transformer input to 100% of the rated voltage and generates the necessary gate signals to turn off the then enabled thyristor pair and enable a different but appropriate thyristor pair, changing the tap thereby again changing the coil turn ratio. However, even though the thyristor gate signal has been removed from the previously conducting thyristor pair, the thyristors continue to conduct until the current returns to zero, i.e., the tap associated with that thyristor pair continues to produce voltage at the transformer output for a portion of a system cycle which could be as long as one-half cycle. A voltage higher than the desired voltage results during that time. In worst case scenarios, this over voltage can be twice the desired voltage.

In order to better understand the phenomenon of over voltage, consider the example depicted in FIG. 1. System cycle degrees are depicted along the horizontal axis and voltage is illustrated along the vertical axis. Degrees and voltage values are for illustrative purposes only. In actual utility applications, such values may differ significantly.

At 90 degrees, the input voltage sags from 10 V to 5 V. Assuming the use of a tap changer using only conventional silicon controlled rectifiers (SCR), the tap changer gates a new SCR pair, changing the coil turn ratio and bringing the output voltage back to the desired output at about the 110 degree point. At about the 270 degree point, input voltage returns to normal. Although the tap changer gates a new pair of SCR's, the prior SCR's are still conducting because the load current has not yet returned to zero. Consequently, the output voltage increases beyond the desired 10 V absolute value. When the current returns to zero at about 370 degree, the prior SCR pair ceases to conduct and the output voltage returns to desired levels. However, the load has been subjected to a significant over voltage.

Although the over voltage in worst cases can be limited through the use of large absorbing transient voltage suppressors, such a solution is both expensive and unacceptable for sensitive loads.

Accordingly, a need still exists for apparatus and methods for a solid state voltage regulator, such as a tap changer, which is capable of switching quickly and which avoids the problem of over voltage.

SUMMARY OF INVENTION

The above described problems are resolved and other advantages are achieved in a solid state voltage regulator and methods therefore. The regulator includes a transformer having a secondary coil, the secondary coil having a plurality of taps. A first solid state switch is connected between the regulator output and a first tap. The first switch need only have the capability of being turned on in response to a gate signal. A second solid state switch is connected between the regulator output and a second tap. The second switch has the capability of being turned on and turned off in response to gating signals. The output voltage resulting from the second tap is greater than the first tap. A controller, connected to the input, the output, the first switch and the second switch, senses the voltage present at the regulator input and output and generates gating signals in response to the sensed voltage. The voltage regulator may include several switches similar in construction and operation to the first switch. In such a regulator, the second switch is connected to the tap which results in the coil turn ratio yielding the greatest voltage compensation.

BRIEF DESCRIPTION OF THE DRAWINGS

The present invention will be better understood, and its numerous objects and advantages will become apparent to those skilled in the art by reference to the following detailed description of the invention when taken in conjunction with the following drawings, in which.

DETAILED DESCRIPTION OF THE INVENTION

Figure 1:
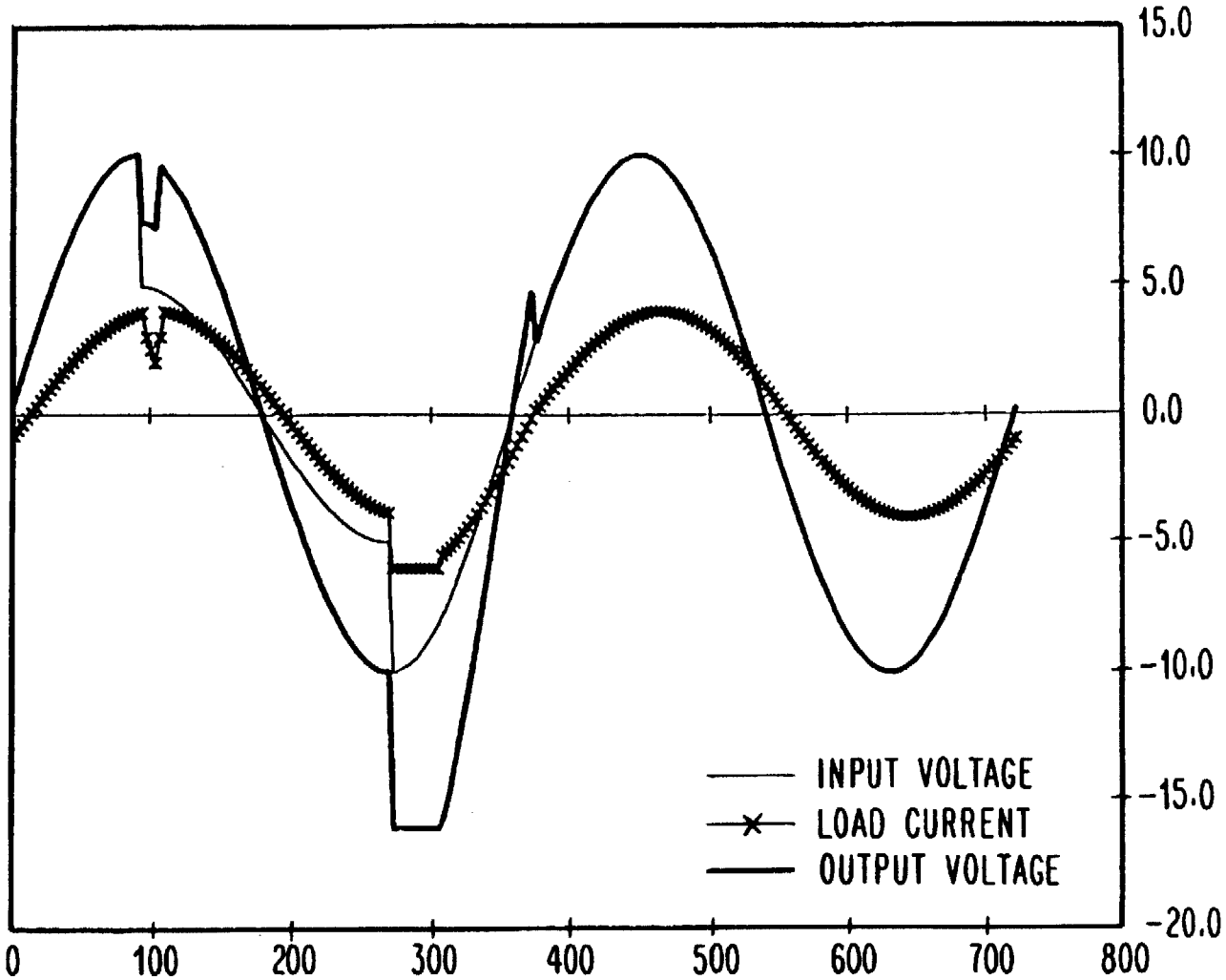
FIG. 1 is a graph of an example of voltage and current waveforms for a conventional SCR voltage regulator.
Figure 2:
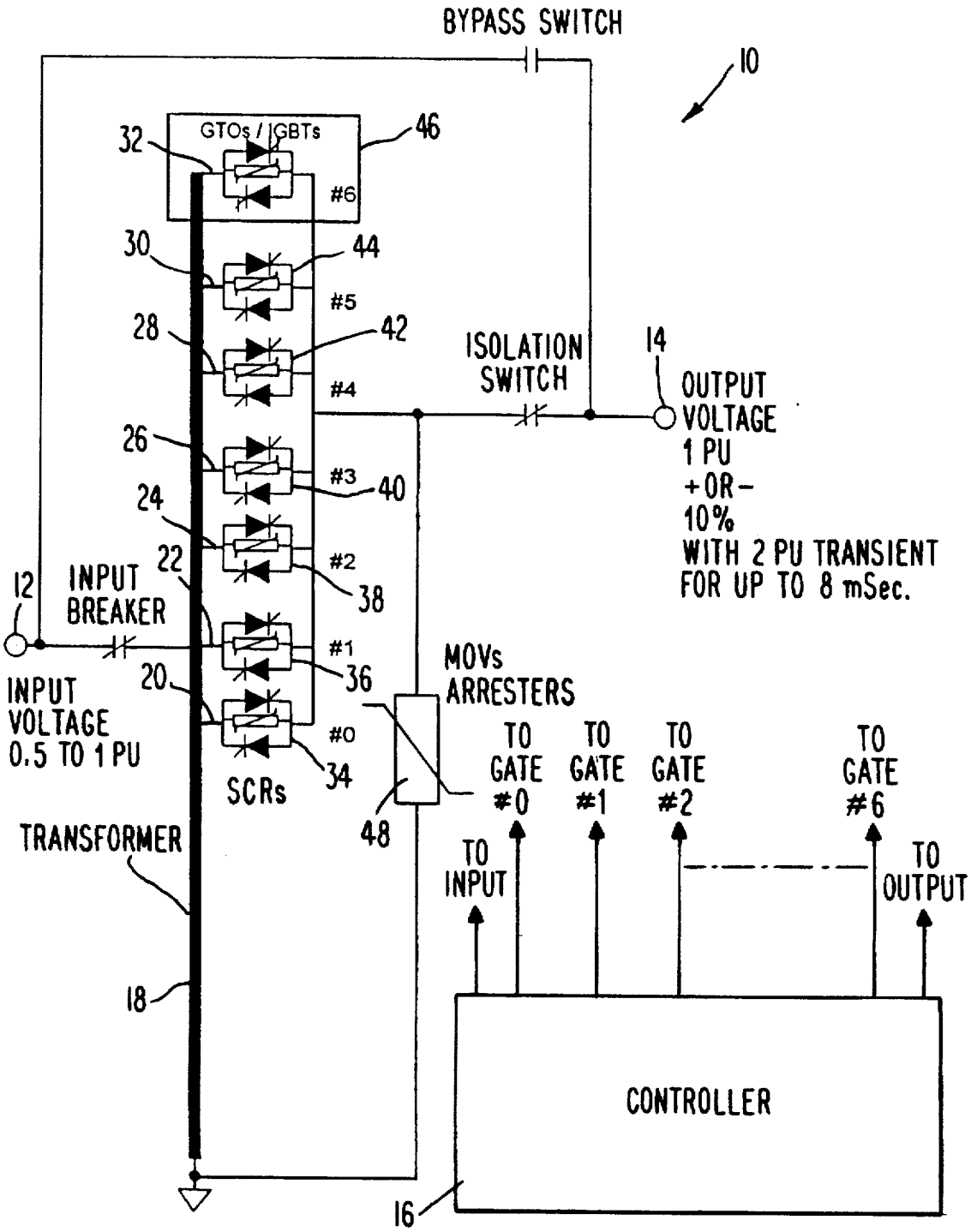
FIG. 2 is a diagrammatic view of voltage regulator constructed in accordance with the present invention.

Referring to FIG. 2, there is shown a voltage regulator 10 constructed in accordance with the present invention. Regulator 10 has an input 12 and an output 14. A controller 16 is connected to sense voltage levels at input 12 and output 14. Transformer 18 is connected to input 12.

Transformer 18 includes a primary coil (not shown) and a tapped secondary coil. Since the design of transformer 18 is well known it will not be described in greater detail herein. A number of conductor elements 20–32 are connected to various of the taps of transformer 18. It will be understood that while seven taps are shown in FIG. 2, transformer 18 can include numerous designs and be provided with more or less taps than depicted.

For purposes of illustrating the invention, tap 22 of transformer 18 incorporates the coil turn ratio necessary to provide the desired output voltage when the voltage at input 12 is at 100% of its expected level. Taps 24 through 32 respectively are assembled to achieve a turn ratio which is approximately 10% higher than the previous tap. For example if the voltage level at input 12 were to sag from its expected value by 30%, tap 28 is constructed to yield a coil turn ratio that would maintain the desired output voltage level. Accordingly, tap 32 is able to maintain the desired output voltage level if the input voltage were to sag by 50%.

A silicon controlled rectifier (SCR) is connected between taps 20–30 and output 14. In the preferred embodiment, each SCR includes a thyristor pair connected in an antiparallel. Since no specific design for the SCR solid state switch is required, no further description will be given. Such SCR's are and have been commercially available from, for example, ABB high powered semi-conductors a Swiss company having a sales office in the United States. Controller 16 is also connected to each of SCRs 24–44. Controller 16 generates the gating signals necessary to turn on an SCR. The generation of such gating signals is also known.

Tap 32 is connected to a second kind of solid state switch 46, namely either a gate turnoff pyristor (GTO) or an insulated gate bi-polar transistor (IGBT). GTOs and IBGTs are also commercially available. It will be understood that GTOs and IGBTs have a common operating characteristic, namely that each is capable of a controlled turn-off. Compared to SCR switches which only turnoff when load current returns to zero (commutation), GTOs/IBGTs can be commanded to turn off by the generation of an appropriate control signal. Once commanded to turn off, GTOs/IBGTs take approximately 600 microseconds to turn off.

While one might recognize at this point that the over voltage problem could be overcome by the exclusive use of GTOs/IBGTs, such a solution would result in an overly expensive voltage regulator.

A metal oxide varistor (MOV) arrestor 48, is also provided between output 14 and ground. Arrestor 48 serves to clamp the output voltage at about 1.3 times the desired output voltage.

Figure 3:
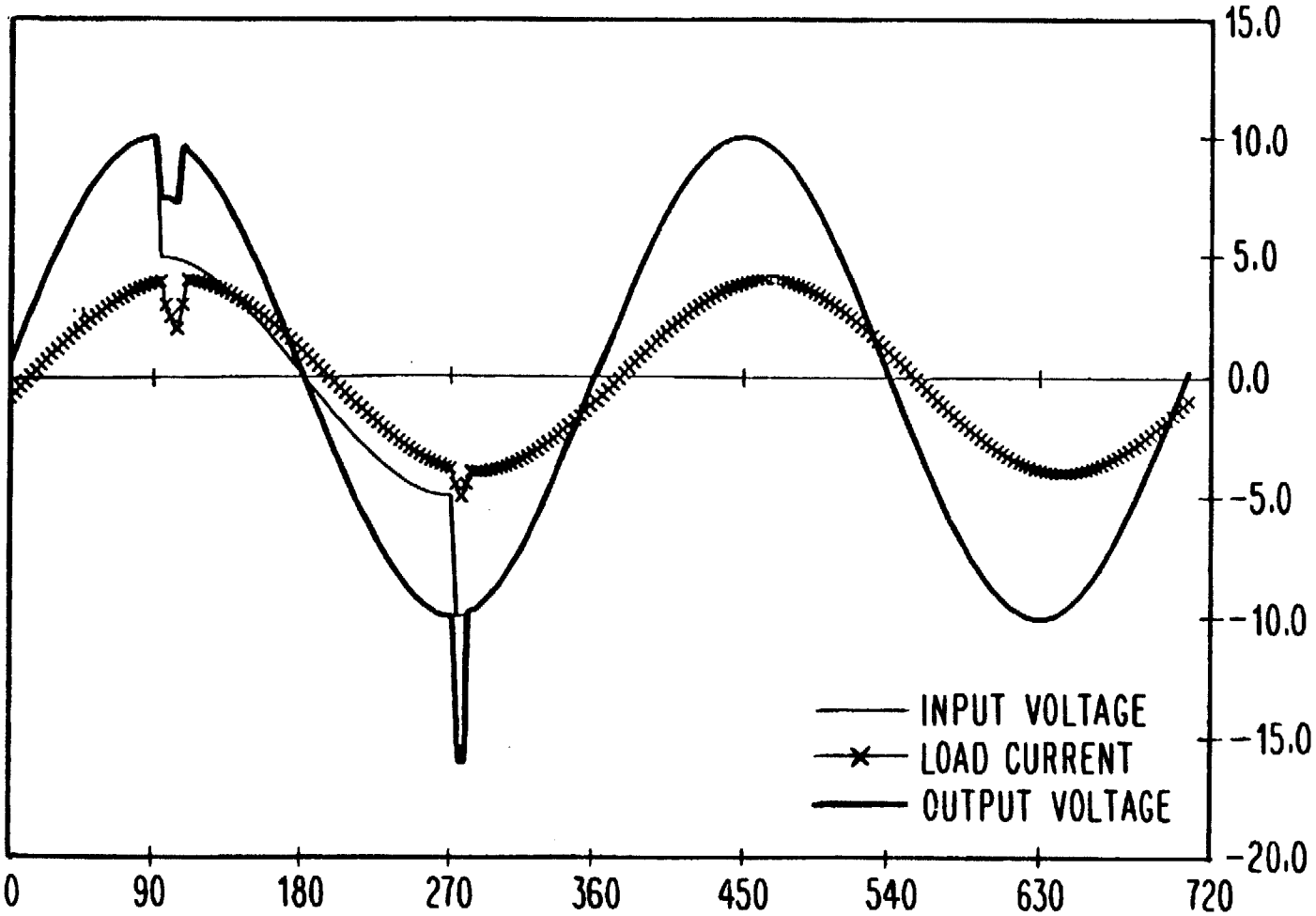
FIG. 3 is a graph of a voltage and current waveforms for the voltage regulator depicted in FIG. 2.

Consider now the operation of regulator 10 under various sag conditions. First, consider the situation where input voltage sags by 50%. In such a case, controller 16, sensing the sag in input voltage generates a signal enabling or turning on switch 46. Output voltage is maintained at the desired level. When input voltage returns to 100% of its expected level, controller 16 generates a command signal turning off switch 46. Any over voltage that occurs only occurs for approximately 600 microseconds. Waveforms demonstrating such behavior are shown in FIG. 3. The short over voltage occurs for only a few degrees.

Now consider the situation where the input voltage sag is less than 50% of the expected level. Assume that input voltage sags by 30%. Controller 16, sensing the sag in input voltage generates the necessary gating signal to disable switch 36 and enable switch 42. When the input voltage returns to 100% of its expected value, controller 16 sensing the increase in input voltage generates the gating signals necessary to disable switch 42 and enable switch 36. However, switch 42 is a thyristor based switch, i.e. it will not stop conducting until current returns to zero. However, another phenomenon of SCR switches can be utilized to significantly curtail over voltage, namely controller 16 turns on switch 46.

Because switch 46 is either a GTO or IBGT device, if it is turned on at the same time switch 36 is enabled, a reverse bias situation is caused, immediately turning off switch 42.

However, switch 46 is now on and if left on will generate more voltage than is needed at the output. But switch 46 can be commanded to turn off. Controller 16 then generates a signal turning off switch 46 and commutates current from switch 46 to any of the appropriate switches 32 to 44 as described previously.

Using the above described approach only one gate controllable turnoff device is required.

While the invention has been described and illustrated with reference to specific embodiments, those skilled in the art will recognize that modification and variations may be made without departing from the principles of the invention as described herein above and set forth in the following claims.

What is claimed is:

1. A voltage regulator, having an input and an output on which output a desired voltage is to be regulated, said voltage regulator comprising:

a transformer having a secondary coil, said secondary coil having a plurality of taps;

a first solid state switch, connected between said output and a first one of said taps, said first switch having the capability of being turned ON in response to a first gate signal;

a second solid state switch, connected between said output and a second of said taps, said second switch having the capability of being turned ON and turned OFF in response to a second gate signal;

a third solid state switch, connected between said output and a third one of said taps, said third switch having the capability of being turned ON in response to a third gate signal; and a controller, connected to said input, said output, said first switch and said second switch, for sensing the voltage present at said input and said output and for generating gating signals in response to the voltage sensed at said input and said output, wherein said controller changes from said first tap to said third tap by removing the gating signal from said first switch, generating said second and third gate signals to turn ON said second and third switches and thereafter generating said second gate signal to turn OFF said second switch.

2. The regulator of claim 1, wherein said first solid state switch comprises silicon controlled rectifiers.

3. The regulator of claim 1, wherein said first solid state switch comprises thyristors.

4. The regulator of claim 1, wherein said second solid state switch comprises a GTO.

5. The regulator of claim 1, wherein said second solid state switch comprises an IGBT.

6. The regulator of claim 1, wherein the output voltage resulting from said second tap is greater than the output voltage from said first and third tap.

7. The regulator of claim 1, wherein said second solid state switch is the only solid state switch in said regulator having the capability of being turned on and turned off in response to a gate signal.

8. A method of regulating the output of a voltage regulator, having a transformer with a secondary coil, said secondary coil having a plurality of taps, and having first and third solid state switches, connected between said output and a first one and a third one, of said taps, said first and third switches having the capability of being turned ON in response to first and third gate signals, said method comprising the steps of;

providing a second solid state switch, between said output and a second of said taps, said second switch having the capability of being turned ON and turned OFF in response to a second gate signal and wherein the output voltage resulting from said second tap is greater than said first and third taps;

sensing the voltage present at said input and said output; and when desired to switch from said first tap to said third tap, removing said first gate signal, generating said second and third gate signals to turn ON said second and third switches and and thereafter generating a signal to turn OFF said second switch.

* * * * *